US011600243B2

(12) United States Patent
Zhong et al.

(10) Patent No.: US 11,600,243 B2
(45) Date of Patent: Mar. 7, 2023

(54) DISPLAY CONTROLLER, DISPLAY CONTROL METHOD, AND DISPLAY CONTROL SYSTEM FOR COLOR SPACE CONVERSION

(71) Applicant: VeriSilicon Holdings Co., Ltd., Cayman Islands (KY)

(72) Inventors: Lefan Zhong, San Jose, CA (US); Song Li, San Jose, CA (US); Jun Chen, San Jose, CA (US); Isaac Wang, San Jose, CA (US)

(73) Assignees: VeriSilicon Microelectronics (Shanghai) Co., Ltd., Pudong New Area (CN); VeriSilicon Holdings Co., Ltd., Grand Cayman (KY)

( * ) Notice: Subject to any disclaimer, the term of this patent is extended or adjusted under 35 U.S.C. 154(b) by 0 days.

(21) Appl. No.: 17/402,644

(22) Filed: Aug. 16, 2021

(65) Prior Publication Data

US 2022/0051640 A1 Feb. 17, 2022

Related U.S. Application Data

(60) Provisional application No. 63/065,509, filed on Aug. 14, 2020, provisional application No. 63/065,510, filed on Aug. 14, 2020.

(51) Int. Cl.
*G09G 5/06* (2006.01)

(52) U.S. Cl.
CPC ..... *G09G 5/06* (2013.01); *G09G 2320/0666* (2013.01); *G09G 2340/06* (2013.01)

(58) Field of Classification Search
CPC ..... G09G 5/06; G09G 3/2092; G09G 3/2003; G09G 2320/0666; G09G 2320/0285; G09G 2340/06
See application file for complete search history.

(56) References Cited

U.S. PATENT DOCUMENTS

2016/0027365 A1* 1/2016 Kempf ..... G09G 3/2003 345/690
2016/0165201 A1* 6/2016 Ochiai ..... H04N 9/67 348/571
2019/0149697 A1* 5/2019 Novikov ..... H04N 1/6025 358/518
2019/0318448 A1* 10/2019 Giovannelli ..... G06T 1/60

* cited by examiner

*Primary Examiner* — Brent D Castiaux

(57) ABSTRACT

A display controller, comprising a 3D_LUT random access memory, which stores at least a 3D Lookup table; and a display control processing unit, comprising: a computing unit, a register, a color signal booster, and a color signal attenuator; wherein after input color signals are received by the color signal booster, and the color signal booster amplifies color signals by a first predetermined factor, wherein the computing unit calculates the address of the 3D Lookup table, and loads the 3D Lookup table from the 3D_LUT random access memory according to the register, wherein the color signal attenuator attenuates color signals by a second predetermined factor. The present disclosure significantly increases the precision of color conversion from one RGB color space to another RGB color space, and does not increase the RAM cost, since the cost of multiplying or dividing by power of 2, for example, is limited.

13 Claims, 5 Drawing Sheets

DISPLAY CONTROLLER, DISPLAY CONTROL METHOD, AND DISPLAY CONTROL SYSTEM FOR COLOR SPACE CONVERSION

CROSS REFERENCE TO RELATED APPLICATION

The present application claims the benefit of priority to U.S. Provisional Patent Application No. 63/065,510, entitled "3D-LUT ENHANCE FEATURE WITH BOOST THE LOW LIGHT", and U.S. Provisional Patent Application No. 63/065,509, entitled "DATA COMPRESSION WITH FIXED VLC AND SIZE RUN-LENGTH ADAPTIVE ARRANGEMENT, both of which are filed with USPTO on Aug. 14, 2020, the disclosure of which are incorporated herein by reference in their entirety for all purposes.

FIELD OF TECHNOLOGY

The present disclosure generally relates to graphics processing, in particular, to a display controller, a display control method, and a display control system for color space conversion.

BACKGROUND 3D lookup tables (3D LUTs) are used to map one color space to another. They are commonly used to calculate preview colors for a monitor or digital projector of how an image will be reproduced on another display device. A 3D RGB LUT is a 3D lattice of output RGB color values that can be indexed by sets of input RGB color values. Each axis of the lattice represents one of the three input color components (R, G, or B) and the input color thus defines a point inside the lattice. Since the point may not be on a lattice point, the lattice values must be interpolated; most products use tri-linear interpolation.

BT.709 is the canonical reference from the International Telecommunication Union Radiocommunication Sector (ITU-R) which standardizes the image encoding and signal characteristics of high-definition television (HDTV). It was first approved in 1990. In comparison, BT.2020 defines various aspects of ultra-high-definition television (UHDTV) with standard dynamic range (SDR) and wide color gamut (WCG), and it was first posted on the International Telecommunication Union (ITU) website in 2012.

Because of the increasing popularity of UHDTVs in recently years, a way to transform color signals of the color space defined by BT.709 into color signals of the color space defined by BT. 2020 is needed.

SUMMARY

The present disclosure provides a display controller, including: a 3D_LUT random access memory, which stores at least a 3D Lookup table; and a display control processing unit, which includes a computing unit, a register, a color signal booster, and a color signal attenuator.

After input color signals are received by the color signal booster, and the color signal booster amplifies color signals by a first predetermined factor. The computing unit calculates the address of the 3D Lookup table, and loads the 3D Lookup table from the 3D_LUT random access memory according to the register. The color signal attenuator attenuates color signals by a second predetermined factor.

The present disclosure further provides a display control method, including: receiving input color signals by a display controller; amplifying all or part of the input color signals by a first predetermined factor by a color signal booster, and obtaining boosted color signals; loading a pre-stored 3D Lookup table (3D_LUT) from a 3D_LUT RAM by a computing unit; dividing the boosted color signals into three channels and storing the divided color signals on a color channel memory; comparing a point (r, g, b) of the divided color signals with lattice points of the 3D_LUT; based on the comparison result, determining whether or not to approximate the position of the point (r, g, b) among the lattice points; through tri-linear interpolation, approximating the position of the point (r, g, b) among the lattice points by the computing unit, after which the divided color signals turn into interpolated color signals; and attenuating the interpolated color signals by a second predetermined factor by a color signal attenuator to obtain attenuated color signals.

The present disclosure further provides a display control system, including a central processing unit, an image memory, and the display controller described above. The central processing unit receives input data, and outputs data to the image memory, and the display controller.

DETAILED DESCRIPTION

One or more specific embodiments of the present disclosure will be described below. These described embodiments are only examples of the presently disclosed techniques, and are not intended to limit aspects of the present disclosure. Additionally, in an effort to provide a concise description of these embodiments, all features of an actual implementation may not be described in the specification. It should be appreciated that in the development of any such actual implementation, numerous implementation-specific decisions must be made to achieve the developers' specific goals, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

In addition, herein, terms such as "first", "second", etc. are only used to distinguish one entity or operation from another entity or operation, and do not necessarily require these entities or operations be in a certain order.

Some display controllers are able to convert color signals stored in a memory to color signals of another standard, and control a display to show images represented by the latter. Take BT. 709 RGB, BT. 2020 RGB, and their respective color spaces for example. Theoretically, the relationship between BT. 709 RGB color signals and BT. 2020 RGB color signals may be given by:

$$\begin{bmatrix} R \\ G \\ B \end{bmatrix}_{2020} = \begin{bmatrix} 0.6274 & 0.3293 & 0.0433 \\ 0.0691 & 0.9195 & 0.0114 \\ 0.0164 & 0.0880 & 0.8956 \end{bmatrix} \begin{bmatrix} R \\ G \\ B \end{bmatrix}_{709}, \text{ and} \quad (1)$$

$$\begin{bmatrix} R \\ G \\ B \end{bmatrix}_{709} = \begin{bmatrix} 1.6605 & -0.5876 & -0.0729 \\ -0.1246 & 1.1329 & -0.0083 \\ -0.0182 & -0.1006 & 1.1187 \end{bmatrix} \begin{bmatrix} R \\ G \\ B \end{bmatrix}_{2020}. \quad (2)$$

Note that all matrix values above were calculated with high precision and then rounded to four decimal digits. See Colour conversion from Recommendation ITU-R BT.709 to Recommendation ITU-R BT.2020, available at https://www.itu.int/dm_s_pubreditu-r/rec/bt/R-REC-BT.2087-0-201510-I!!PDF-E.pdf.

Figure 2:
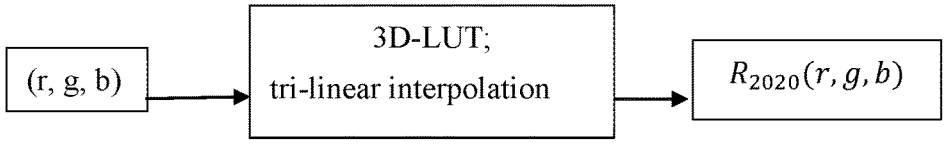
Fig. 2 (Prior art)
FIG. 2 is a flow chart showing the traditional method for converting color signals from one color space to another.

Referring to FIG. 2. Conversions between BT. 2020 RGB color signals and BT. 709 RGB color signals can be facilitated by the above mentioned 3D RGB LUTs where pre-calculated color signal values are stored, which eliminates the need to perform the calculations as shown in (1) and (2) for every input color signal. Taking the R components as an example, theoretically:

$$R_{2020}(r,g,b)=(0.6274r^{2.4}+0.3293g^{2.4}+0.0433b^{2.4})^{1/2.4} \quad (3).$$

The values of $R_{2020}$(r, g,b) at the lattice points (i/N, j/N, k/N) can be pre-calculated, wherein N is the number of nodes on one axis of the 3D RGB LUT and usually N=16. Assume (r,g,b) falls in the range of $i/N \le r < (i+1)/N$, $j/N \le g < (j+1)/N$ and $k/N \le b < (k+1)/N$. Then we have pre-calculate the values of 8 lattice points, as follows:

$$R_{2020}(i,j,k), R_{2020}(i+1,j,k), R_{2020}(i,j+1,k), R_{2020}(i,j,k+1), R_{2020}(i,j+1,k+1), R_{2020}(i+1,j,k+1), R_{2020}(i+1,j+1,k), R_{2020}(i+1,j+1,k+1)$$

The exact value of $$R_{2020}\left(\frac{48}{1024}, \frac{23}{1024}, \frac{16}{1024}\right) \text{ is } \frac{21.46}{1024};$$

when N is 16, the approximated value of $$R_{2020}\left(\frac{48}{1024}, \frac{23}{1024}, \frac{16}{1024}\right)$$

obtained oy using the 3D RGB LUT comprising the pre-calculated lattice points and tri-linear interpolation is $$\frac{31.5}{1024}.$$

Tri-linear interpolation is introduced because not every input color signal's value, i.e., (R, G, B), falls on a lattice point of its corresponding 3D RGB LUT (see https://en.wikipedia.org/wiki/Tri-linear_interpolation). However, as we can see, there is a sizable gap between the exact value (21.46/1026) and the approximated value (31.25/2014), which happens when the input color signal's value is relatively small.

$$\frac{48}{1024}, \frac{23}{1024}, \text{ and } \frac{16}{1024}$$

are relatively small values.

Referring to FIG. 2. One conventional way to solve this problem is to build a bigger LUT stored in the RAM, that is, with more lattice points, and then find an approximated value of the input color signal through tri-linear interpolation. But this approach burdens the RAM where the LUT is stored. For example, when N=16, $3(N+1)^3*10=147{,}390$ bits of RAM space is needed, for a 10-bit table; when N=32, 1,078,110 bits are needed. The latter is 7.3 times of the former. But of course, the bigger N is, the more precise is the color conversion.

Embodiment 1

Figure 3:
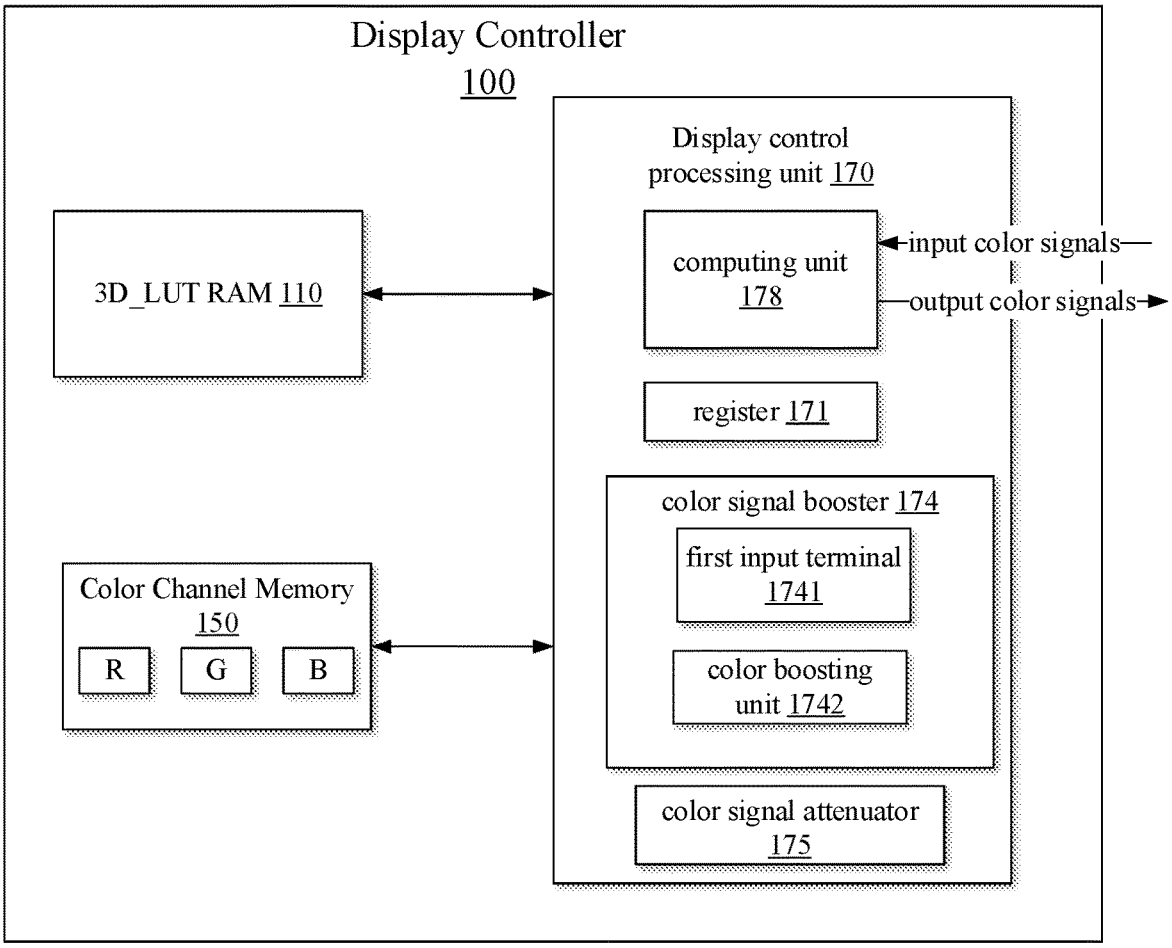
FIG. 3 is a block diagram showing the structure of a display controller according to one embodiment of the present disclosure.
Figure 4:
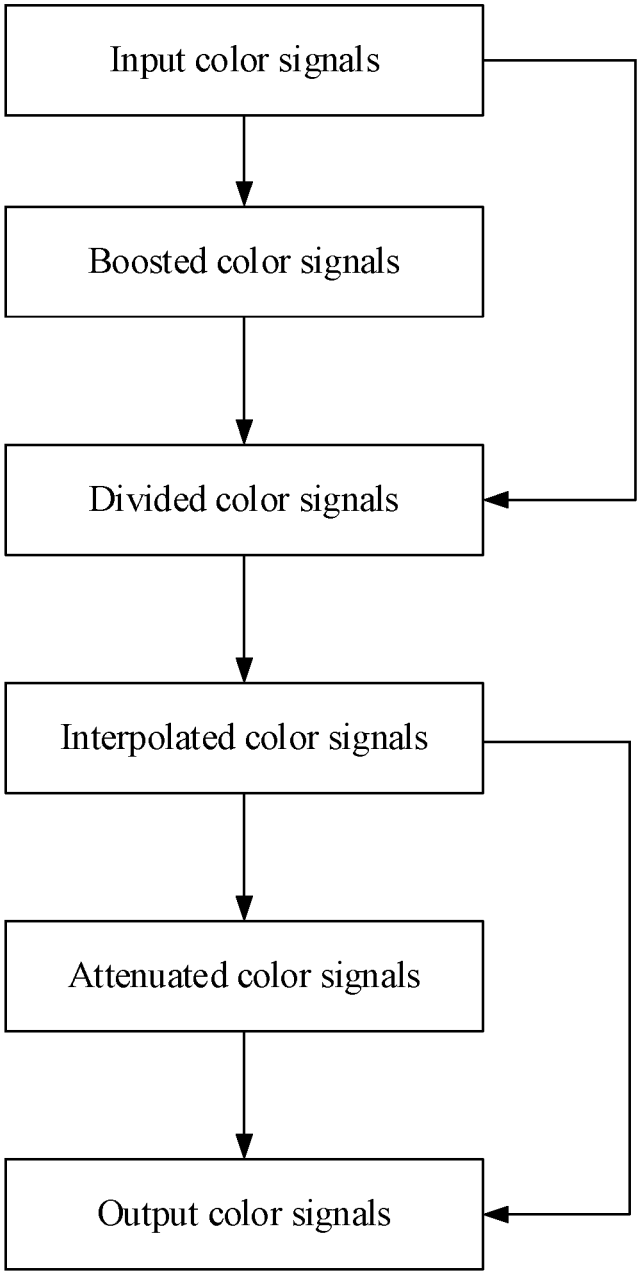
FIG. 4 shows the relationship between different colors signals according to one embodiment of the present disclosure.

The present disclosure provides a display controller 100. As shown in FIG. 3, the display controller includes a 3D_LUT random access memory (RAM) 110, a color channel memory 150, and a display control processing unit 170. The display control processing unit 170 further includes a computing unit 178, a register 171, a color signal booster 174, and a color signal attenuator 175.

The 3D_LUT RAM 110 stores at least a 3D_LUT, whose address is stored in the register 171. The color channel memory 150 includes at least three memory regions, each of which stores data representing color signals of one color channel, for example, a Red (R) channel, Green (G) channel, or Blue (B) channel. The register 171 stores addresses of objects, including the address of the 3D_LUT, and can be accessed by the computing unit 178.

The color signal booster 174 includes a first input terminal 1741 that receives input color signals, a first output terminal that outputs boosted color signals, and a color signal boosting unit 1742 that amplifies the input color signals to obtain the boosted color signals.

In operation, the first input terminal 1741 of the color signal booster 174 receives the input color signals from the computing unit 178 which receives the input color signal from an external device, and the external device may be a memory, a processor, or a transceiver. In some embodiments, the color signal booster 174 receives the input color signals from external environment. After the input color signals are received by the color signal booster 174, the color signal boosting unit 1742 amplifies the input color signals. The input color signals may be analog or digital. Correspondingly, the amplification may be achieved by an amplification circuit, a digital amplifier, or a binary multiplier. The amplification may also be achieved by software stored in a memory unit of the color signal boosting unit 1742, when executed by the computing unit 178, causing the computing unit 178 to perform the above amplification operation. Correspondingly, the color signal boosting unit 1742 may include one or more of an amplification circuit, a digital amplifier, a binary multiplier, and a memory unit storing software that multiplies signals when executed.

The color signal boosting unit 1742 amplifies the input color signals by a predetermined factor F. In some embodiments, the factor F is given by:

$$F=1/\max(r,g,b),$$

wherein r, g, and b are values of the three color channels (Red, Green, and Blue) of the input color signals, and r, g, b are between 0 and 1.

In some embodiments, the factor F is given by:

$$\text{factor}=2^{floor(log_2 1/max(r,g,b))}.$$

Figure 1:
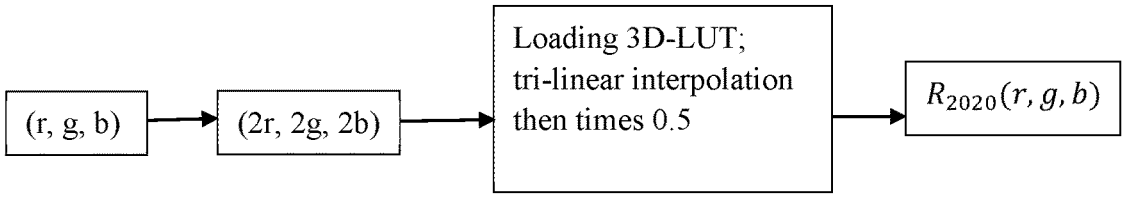
FIG. 1 is a flow chart summarily showing the principle of a method according to one embodiment of the present disclosure.

Referring to FIG. 1, in some embodiments, the factor F is 2.

Note that the input color signals are amplified by the factor F when the relationship between the first color space (corresponding to the input color signals) and the second color space (corresponding to the output color signal) can be represented by Fc(a*r, a*b)=g(a)*Fc(r, g, b), wherein Fc(r, g, b) represents a lattice point of the second color space, and (r, g, b) represents a corresponding lattice point of the first color space. In this case, The relationship between the color spaces corresponding to BT. 2020 RGB and BT. 709 RGB satisfied this requirement, see equations (1) (2) and (3).

More specifically, the following equation is always true:

$$\frac{R_{2020}(r*\text{factor},\ g*\text{factor},\ b*\text{factor})}{\text{factor}} = R_{2020}(r,\ g,\ b).$$

In some embodiments, only some of the input color signals are boosted. Or to put it another way, some of the input color signals may be amplified by a factor of 1. During implementation, whether to boost a color signal may be determined by whether the color signal is a low light color signal, whose values are relatively low. For example, $$(r,\ g,\ b) = \left(\frac{48}{1024},\ \frac{23}{1024},\ \frac{16}{1024}\right)$$

is a low light color signal. A low light color signal may be generated in the environment when the environment lacks illumination. A low light color signal may also be part of normal color signals that has a low value, for example, a darker part of a normal image.

After or before the input color signals are boosted by the color signal booster 174, the computing unit 178 calculates the address of the 3D_LUT, and loads the 3D_LUT from the 3D_LUT RAM 110 according to information of the 3D_LUT RAM 110 in the register 171. Then the boosted color signals are divided by the computing unit 178 into three color channels (R, G, B) for subsequent tri-linear interpolation (hereinafter, divided color signals). Data of the divided color signals may be stored in the color channel memory 150. After tri-linear interpolation, the divided color signals turn into interpolated color signals, which may also be stored in the color channel memory 150.

Specifically, the 3D_LUT may include three sub tables, each of which corresponds to a color channel; that is, the 3D_LUT may include an R sub table, a G sub table, and a B sub table, and all of them are 3D lookup tables, generated by processes described above.

Figure 5:
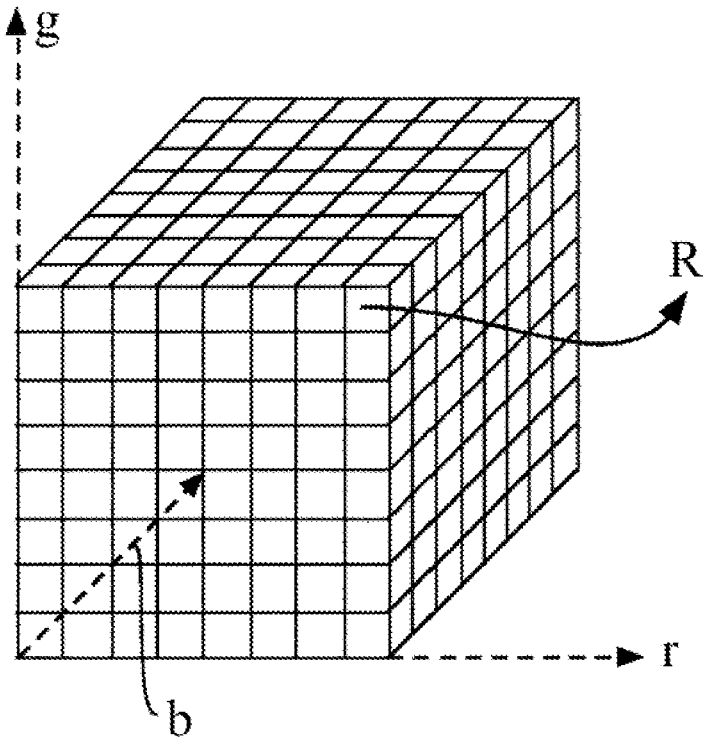
FIG. 5 shows the architecture of a 3D look-up table for the Red component of color signals according to one embodiment of the present disclosure.

Refer to FIG. 5. Take the R channel as an example. During tri-linear interpolation, the computing unit 178 reads the R sub table, and then each point (r,g,b) of the R channel is compared to lattice points of the R sub table. For each point (r,g,b), if it coincides with one of the lattice points, then the value of this lattice point is recorded as the value of the R component in the second color space, while the value of the R component in the first color space is r; in this case, no interpolation is needed. When the second color space corresponds to BT. 2020 RGB, the value of this lattice point is denoted as R_2020. If the point (r, g, b) does not coincide with any of the lattice points of the R sub table, then tri-linear interpolation is performed by the computing unit 178 to approximate the position of the point (r, g, b) among the lattice points.

Detailed tri-linear interpolation processes can be found at: http://en.wikipedia.org/wiki/Trilinear_interpolation.

The approximated position has a corresponding value, given by $$R_{2020}(r',g',b')=0.6274r'^{2.4}+0.3293g'^{2.4}+0.0433b'^{2.4})^{1/2.4},$$

wherein (r',g',b') represents the approximated position, and is part of the interpolated color signals.

Then a determination is made as to whether the point (r,g,b) is from a color signal that has been boosted. If the point (r, g, b) is from an input color signal that has been amplified by a factor larger than 1, then it is from a color signal that has been boosted, in which case the corresponding interpolated color signal will be attenuated by the color signal attenuator 175 by another predetermined factor F'. In some embodiments, the factor F' is the reciprocal of the factor F. In some embodiments, the factor F' is equal to the factor F. The color signal attenuator 175 may include one or more of an attenuator circuit, a digital attenuator, a binary divider, and a memory unit storing software that scales down signals when executed. After the attenuation, the corresponding interpolated color signal turns into an attenuated color signal, which is then output as the output color signal.

If the (r, g, b) is from an input color signal that has not been boosted, then the corresponding interpolated color signal is output by the computing unit 178 as an output color signal without being first attenuated.

In some embodiments, the display controller 100 does not include a color channel memory. In some embodiments, the various color signals mentioned above are not stored in a memory during the implementation. In some embodiments, the various color signals mentioned above are stored in the 3D_LUT RAM 110 during the implementation.

FIG. 3 shows the relationship between different colors signals for the sake of understanding, and is not intended to limit the scope of the present disclosure. It should be noted that in some embodiments, some of the color signals are not be present. For example, in some embodiments, the divided color signals are not present, and the corresponding structures, for example, the color channel memory, are modified accordingly It needs to be noted that the division of the display controller 100 is only a logical function division, and the corresponding components can be fully or partially integrated into a physical entity or physically separated in the actual implementation. In one embodiment, these components can all be implemented in the form of software called by a processor. In one embodiment, they can also be all implemented in the form of hardware. In one embodiment, some of the components can also be realized in the form of software called by a processor, and some of the components can be realized in the form of hardware. For example, the display control processing unit 170 may be a separate processing unit, or it may be integrated into a chip of the display controller, or it may be stored in the memory of the device in the form of codes, and the function of the component may be performed by a processor of the device. In addition, all or part of these components can be integrated together, or can be implemented independently. The display control processing unit 170 may be an integrated circuit capable of processing signals. In some embodiments, the register 171, the color signal booster 174, and the color signal attenuator 175 may be realized on a different chip than the computing unit 178.

Embodiment 2

Figure 6:
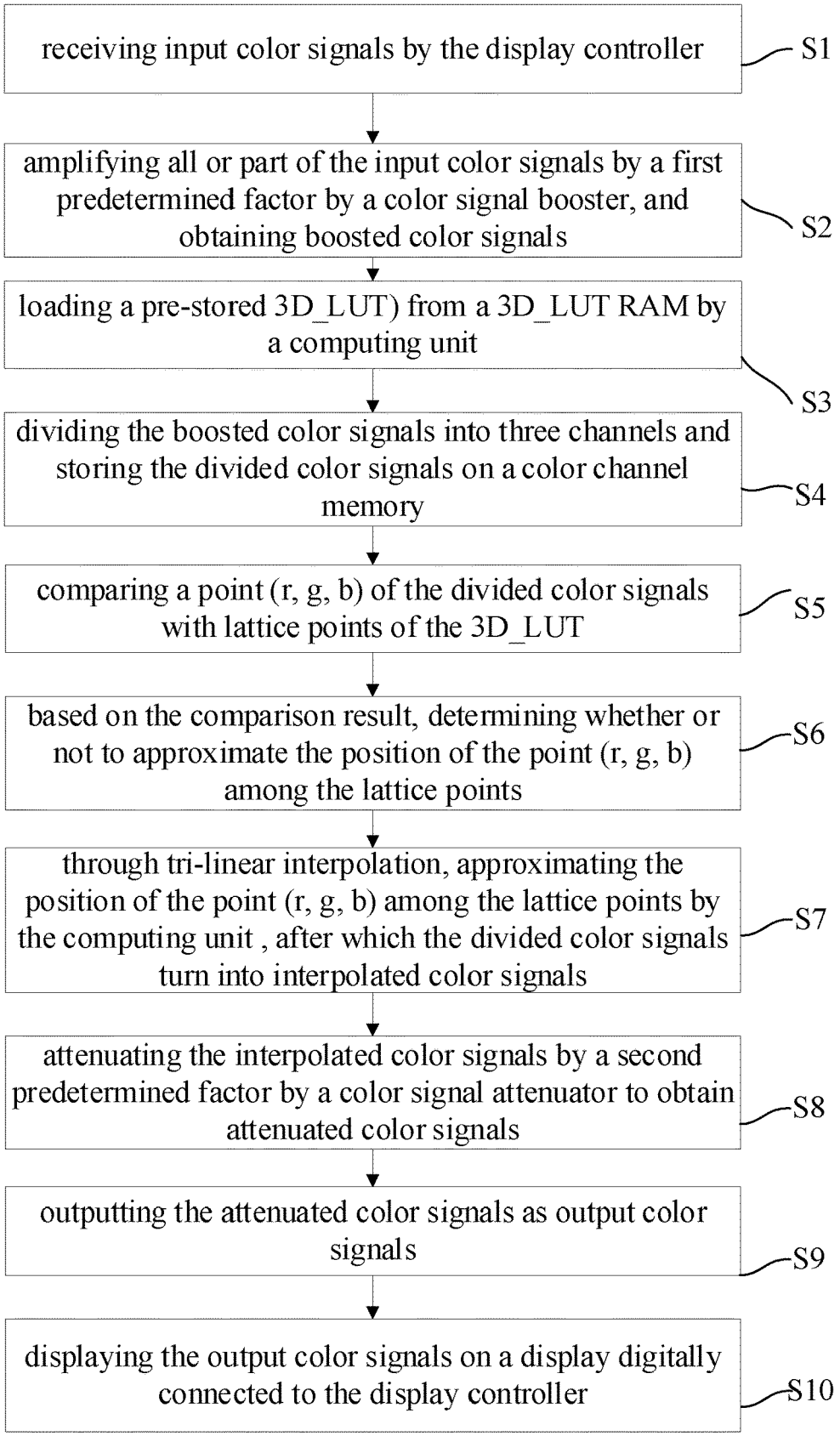
FIG. 6 is a flow chart showing various steps of a display control method according to one embodiment of the present disclosure.

Referring to FIG. 6, the present disclosure further discloses a display control method. In some embodiments, the display control method can be implemented by the above described display controller 100, but the method can be implemented by other hardware, software, or a combination thereof. The display control method, as illustrated by using the display controller 100 as an example, includes the following operations S1, S2, S3, S4, S5, S6, S7, S8, S9 and S10:

S1. receiving input color signals by the display controller 100;

S2. amplifying all or part of the input color signals by a first predetermined factor by a color signal booster 174, and obtaining boosted color signals;

S3. loading a pre-stored 3D lookup table (3D_LUT) from a 3D_LUT RAM 110 by a computing unit 178;

S4. dividing the boosted color signals into three channels and storing the divided color signals on a color channel memory 150;

S5. comparing a point (r, g, b) of the divided color signals with lattice points of the 3D_LUT;

S6. based on the comparison result, determining whether or not to approximate the position of the point (r, g, b) among the lattice points;

S7. through tri-linear interpolation, approximating the position of the point (r, g, b) among the lattice points by the computing unit 178, after which the divided color signals turn into interpolated color signals;

S8. attenuating the interpolated color signals by a second predetermined factor by a color signal attenuator to obtain attenuated color signals;

S9. outputting the attenuated color signals as output color signals;

S10. displaying the output color signals on a display digitally connected to the display controller.

Specifically, the display controller 100 may include the 3D_LUT random access memory (RAM) 110, the color channel memory 150, and a display control processing unit 170. The display control processing unit 170 further includes a computing unit 178, a register 171, the color signal booster 174, and the color signal attenuator 175. The 3D_LUT RAM 110 stores at least a 3D_LUT, whose address is stored in the register 171. The color channel memory 150 includes at least three memory regions, each of which stores data representing color signals of one color channel (aka, color component) (for example, Red, Green, or Blue). The register 171 stores addresses of objects, including the address of the 3D_LUT, and can be accessed by the computing unit 178. The color signal booster 174 includes a first input terminal 1741 that receives input color signals, a first output terminal that outputs boosted color signals, and a color signal boosting unit 1742 that amplifies the input color signals to obtain the boosted color signals.

At S1, the color signal booster 174 receives the input color signals from the computing unit 178 which receives the input color signal from an external device, and the external device may be a memory, a processor, or a transceiver. In some embodiments, the color signal booster 174 receives the input color signals from the environment.

At S2, after the input color signals are received by the color signal booster 174, the color signal boosting unit amplifies the input color signals. The input color signals may be analog or digital. Correspondingly, the amplification may be achieved by an amplification circuit, a digital amplifier, or a binary multiplier. The amplification may also be achieved by software stored in a memory unit of the color signal boosting unit. Correspondingly, the color signal boosting unit may include one or more of an amplification circuit, a digital amplifier, a binary multiplier, and a memory unit storing software that multiplies signals when executed. The color signal boosting unit amplifies the input color signals by a predetermined factor F. In some embodiments, the factor F is given by:

$$F=1/\max(r,g,b),$$

wherein r, g, and b are values of the three color channels (Red, Green, and Blue) of the input color signals, and r, g, b are between 0 and 1.

In some embodiments, the factor F is given by:

$$\text{factor}=2^{floor(\log_2 1/max(r,g,b))}.$$

In some embodiments, the factor F is 2.

Note that the input color signals are amplified by the factor F only when the relationship between the first color space (corresponding to the input color signals) and the second color space (corresponding to the output color signal) can be represented by Fc(a*r, a*b)=g(a)*Fc(r, g, b), wherein Fc(r, g, b) represents a lattice point of the second color space, and (r, g, b) represents a corresponding lattice point of the first color space. In this case, The relationship between the color spaces corresponding to BT. 2020 RGB and BT. 709 RGB satisfied this requirement, see equations (1) (2) and (3).

More specifically, the following equation is always true:

$$\frac{R_{2020}(r*\text{factor},\ g*\text{factor},\ b*\text{factor})}{\text{factor}}=R_{2020}(r,\ g,\ b).$$

In some embodiments, only some of the input color signals are boosted. Or to put it another way, some of the input color signals may be amplified by a factor of 1. During implementation, whether to boost a color signal may be determined by whether the color signal is a low light signal, whose values are relatively low. For example, $$(r,\ g,\ b)=\left(\frac{48}{1024},\ \frac{23}{1024},\ \frac{16}{1024}\right)$$

is a low light signal.

At S3, after or before the input color signals are boosted by the color signal booster 174, the computing unit 178 calculates the address of the 3D_LUT, and loads the 3D_LUT from the 3D_LUT RAM 110 according to information of the 3D_LUT RAM 110 in the register 171.

Then at S4, the boosted color signals are divided by the computing unit 178 into three color channels (R, G, B) for subsequent tri-linear interpolation (hereinafter, divided color signals). Data of the divided color signals may be stored in the color channel memory 150. After tri-linear interpolation, the divided color signals turn into interpolated color signals, which may also be stored in the color channel memory 150.

Specifically, the 3D_LUT may include three sub tables, each of which corresponds to a color channel; that is, the 3D_LUT may include an R sub table, a G sub table, and a B sub table, and all of them are 3D lookup tables, generated by processes described above.

At S5, take the R channel as an example, during tri-linear interpolation, the computing unit 178 reads the R sub table, and then each point (r, g, b) of the R channel is compared to lattice points of the R sub table.

At S6, for each point (r, g, b), if it coincides with one of the lattice points, then the value of this lattice point is recorded as the value of the R component in the second color space, while the value of the R component in the first color space is r; in this case, no interpolation is needed. When the second color space corresponds to BT. 2020 RGB, the value of this lattice point is denoted as $R_{2020}$.

At S7, if the point (r, g, b) does not coincide with any of the lattice points of the R sub table, then tri-linear interpolation is performed by the computing unit 178 to approximate the position of the point (r, g, b) among the lattice points. Detailed tri-linear interpolation processes can be found at:

https://en.wikipedia.org/wiki/Trilinear_interpolation.

The approximated position has a corresponding value, given by $$R_{2020}(r',g',b')=(0.6274r'^{2.4}+0.3294'^{2.4}+0.0433b'^{2.4})^{1/2.4},$$

wherein (r', g', b') represents the approximated position, and is part of the interpolated color signals.

At S8, a determination is made as to whether the point (r,g,b) is from a color signal that has been boosted. Then if the point (r,g,b) is from an input color signal that has been amplified by a factor larger than 1, then it is from a color signal that has been boosted, in which case the corresponding interpolated color signal will be attenuated by the color signal attenuator 175 by another predetermined factor F'. In some embodiments, the factor F' is the reciprocal of the factor F. In some embodiments, the factor F' is equal to the factor F. In one embodiment, the value of a color signal before boosting and after the attenuation is the same. The color signal attenuator 175 may include one or more of an attenuator circuit, a digital attenuator, a binary divider, and a memory unit storing software that scales down signals when executed.

At S9, after the attenuation, the corresponding interpolated color signal turns into an attenuated color signal, which is then output as the output color signal. If the (r,g,b) is from an input color signal that has not been boosted, then the corresponding interpolated color signal is output by the computing unit 178 as an output color signal without being first attenuated.

The execution orders of the various steps enumerated in the present disclosure are only examples of the presently disclosed techniques, and are not intended to limit aspects of the present disclosure. Any omission or replacement of the steps, and extra steps consistent with the principles of the present disclosure are within the scope of the present disclosure.

The devices that can implement the display control method described in the present disclosure include but are not limited to devices with the structure of the display controller described herein, and any structural modification and replacement of the prior art made according to the principles of the present disclosure, are included in the scope of the present disclosure.

Embodiment 3

Figure 7:
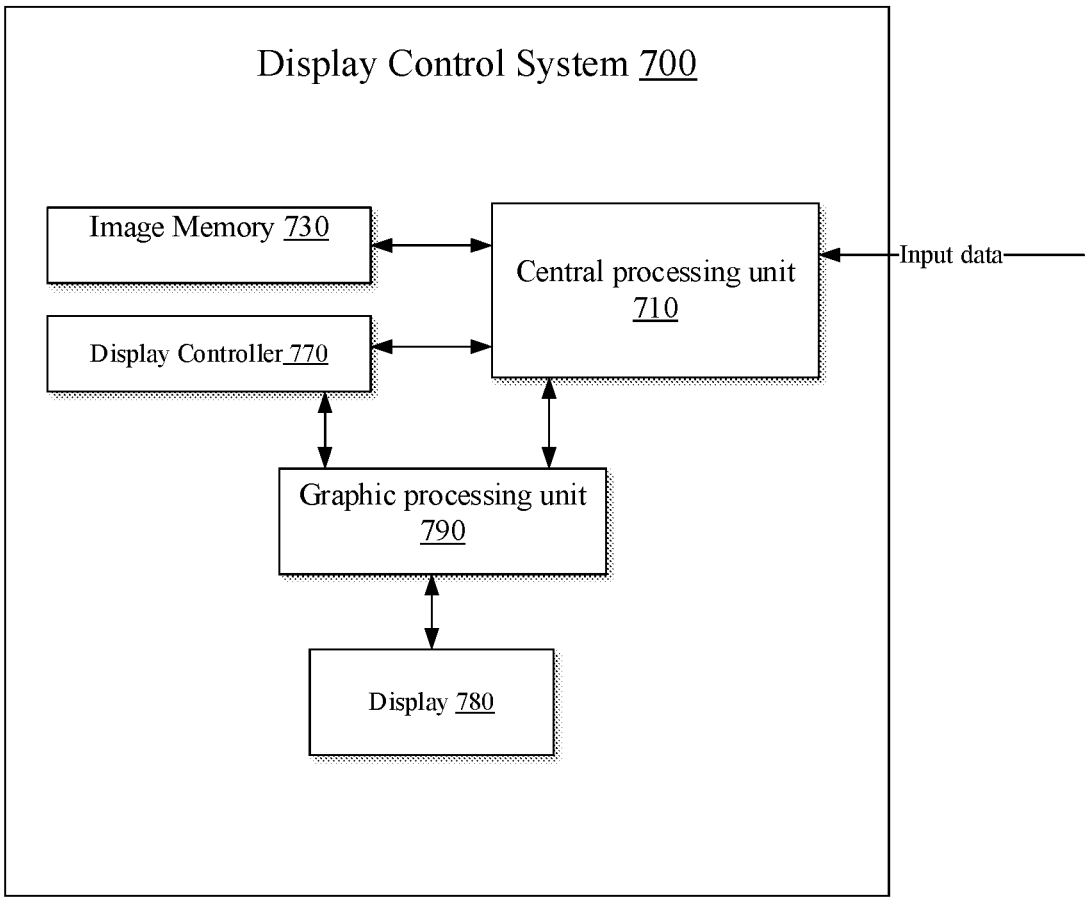
FIG. 7 is a block diagram showing the structure of a display control system according to one embodiment of the present disclosure.

Referring to FIG. 7, the present disclosure further provides a display control system 700, which includes a central processing unit 710, an image memory 730, a display controller 770, a display 780, and a graphic processing unit 790. In some embodiments, the display controller 770 may be implemented by the display controller 110 described above.

The central processing unit 710 receives input data, and outputs data (including color signals) to the image memory 730, the display controller 770, and the graphic processing unit 790. The display controller 770 is operably coupled to the central processing unit 710 and the graphic processing unit 790, converts color signals from one color space to another color space, and outputs converted color signals to the graphic processing unit 790. The graphic processing unit 790 further processes the converted color signals, and then outputs them to the display 780 operably coupled to the graphic processing unit 790.

Embodiment 4

The present disclosure also provides a non-transitory storage medium on which a computer program is stored; when the computer program is executed by a processor, the display control method described above is realized. The memory may be a ROM, RAM, magnetic disk, U disk, memory card, optical disk, or other media that can store program codes.

The present disclosure significantly increases the precision of color conversion from one RGB color space to another RGB color space, and does not increase the RAM cost, since the cost of multiplying or dividing by power of 2, for example, is limited. This may be better explained by a simplified version of the underlying principle of some aspects of the present disclosure. For example, in an embodiment, $$R_{2020}\left(\frac{48}{1024},\frac{23}{1024},\frac{16}{1024}\right)=R_{2020}\left(\frac{2*48}{1024},\frac{2*23}{1024},\frac{2*16}{1024}\right)\Big/2,$$

and the exact value is $$\frac{21.46}{1024}.$$

If we use the 3D-LUT defined in the beginning of the present disclosure, to calculate $$R_{2020}\left(\frac{2*48}{1024},\frac{2*23}{1024},\frac{2*16}{1024}\right),$$

we have $$\frac{52}{1024},$$

which is then divided by 2 to get $$\frac{26}{1024}.$$

The result is closer to the exact value than the result obtained by directly using the 3D-LUT, i.e., $$\frac{31.5}{1024}.$$

If we use the 3D-LUT to calculate $$R_{2020}\left(\frac{4*48}{1024}, \frac{4*23}{1024}, \frac{4*16}{1024}\right),$$

we have $$\frac{87.5}{1024},$$

which is then divided by 4 to get $$\frac{21.85}{1024}.$$

The result becomes warier closer to the exact value.

Furthermore, if we use the 3D-LUT to calculate $$R_{2020}\left(\frac{16*48}{1024}, \frac{16*23}{1024}, \frac{16*16}{1024}\right),$$

we have $$\frac{343.25}{1024},$$

which IS divided by 16 to get $$\frac{21.45}{1024}.$$

The result becomes further closer to the exact value.

The precision achieved by the present disclosure is better than traditional methods (a precision up to 4 times higher than the traditional methods can be obtained by the present disclosure).

The present disclosure has been incorporated into practical applications, as evidenced by the Applicant's experimental product, Verisilicon DC8000.

While particular elements, embodiments, and applications of the present disclosure have been shown and described, it is understood that the disclosure is not limited thereto because modifications may be made by those skilled in the art, particularly in light of the foregoing teaching. It is therefore contemplated by the appended claims to cover such modifications and incorporate those features which come within the spirit and scope of the disclosure.

What is claimed is:

1. A display controller, comprising:

a 3D_LUT random access memory, which stores at least a 3D Lookup table; and a display control processing unit, comprising: a computing unit, a register, a color signal booster, and a color signal attenuator, wherein after input color signals are received by the color signal booster, and the color signal booster linearly amplifies color signals by a first factor, wherein the computing unit calculates the address of the 3D Lookup table, and loads the 3D Lookup table from the 3D_LUT random access memory according to the register, wherein the color signal attenuator linearly attenuates color signals by a second factor.

2. The display controller according to claim 1, further comprising a color channel memory, wherein the color channel memory comprises at least three regions, each of which stores data representing color signals of one color channel, wherein the one color channel is a R channel, G channel, or B channel.

3. The display controller according to claim 1, wherein the input color signals are low light color signals.

4. The display controller according to claim 1, wherein the first factor is the reciprocal of the second factor.

5. The display controller according to claim 2, wherein the 3D Lookup table comprises three sub tables, each of which corresponds to a color channel.

6. A display control method, comprising:

receiving input color signals by a display controller;

linearly amplifying all or part of the input color signals by a first factor by a color signal booster, and obtaining boosted color signals;

loading a pre-stored 3D Lookup table (3D_LUT) from a 3D_LUT RAM by a computing unit;

dividing the boosted color signals into three channels and storing the divided color signals on a color channel memory;

comparing a point (r, g, b) of the divided color signals with lattice points of the 3D_LUT;

based on the comparison result, determining whether or not to approximate the position of the point (r, g, b) among the lattice points;

through tri-linear interpolation, approximating the position of the point (r, g, b) among the lattice points by the computing unit, after which the divided color signals turn into interpolated color signals; and linearly attenuating the interpolated color signals by a second factor by a color signal attenuator to obtain attenuated color signals.

7. The display control method according to claim 6, further comprising:

outputting the attenuated color signals as output color signals; and displaying the output color signals on a display digitally connected to the display controller.

8. The display control method according to claim 6, wherein the input color signals are low light color signals.

9. The display control method according to claim 6, wherein the first factor is the reciprocal of the second factor.

10. The display control method according to claim 6, wherein the first factor is given by 1/max(r, g, b).

11. The display control method according to claim 6, wherein the first factor is given by:

$$\text{factor}=2^{floor(\log_2 1/max(r,g,b))}.$$

12. A display control system, comprising a central processing unit, an image memory, and a display controller;

wherein the central processing unit receives input data, and outputs data to the image memory, and the display controller, wherein the display controller comprises:

a 3D_LUT random access memory, which stores at least a 3D Lookup table; and a display control processing unit, comprising: a computing unit, a register, a color signal booster, and a color signal attenuator;

wherein after input color signals are received by the color signal booster, and the color signal booster linearly amplifies color signals by a first factor, wherein the computing unit calculates the address of the 3D Lookup table, and loads the 3D Lookup table from the 3D_LUT random access memory according to the register, and wherein the color signal attenuator linearly attenuates color signals by a second factor.

13. The display control system according to claim 12, further comprising:

a graphic processing unit operably coupled to display controller; and a display operably coupled to the graphic processing unit, wherein the graphic processing unit further processes the attenuated color signals, and then outputs them to the display.

* * * * *